United States Patent [19]

Swahlan

[11] Patent Number: 4,822,207

[45] Date of Patent: Apr. 18, 1989

[54] ANTI-TERRORIST VEHICLE CRASH IMPACT ENERGY ABSORBING BARRIER

[75] Inventor: David J. Swahlan, Albuquerque, N. Mex.

[73] Assignee: The United States of America as represented by the United States Department of Energy, Washington, D.C.

[21] Appl. No.: 207,849

[22] Filed: Jun. 17, 1988

[51] Int. Cl.[4] ..... E01F 13/00

[52] U.S. Cl. ..... 404/6; 49/33; 49/49; 49/131; 188/377

[58] Field of Search ..... 404/6, 9–11; 256/1, 13.1; 49/9, 33, 49, 131; 104/249, 254, 257, 259; 188/371, 377

[56] References Cited

U.S. PATENT DOCUMENTS

| | | | |
|---|---|---|---|
| 1,611,293 | 12/1926 | Tausch | 104/254 |
| 2,356,559 | 8/1944 | Banschbach | 49/49 |
| 2,997,325 | 8/1961 | Peterson | 104/254 X |
| 3,448,963 | 6/1969 | Gravisse | 404/10 X |
| 3,712,589 | 1/1973 | Peterson et al. | 404/6 X |
| 3,913,264 | 10/1975 | Kohen | 49/49 |
| 4,007,917 | 2/1977 | Brubaker | 404/6 X |
| 4,101,115 | 7/1978 | Meinzer | 404/6 X |
| 4,332,503 | 6/1982 | Hurst, Jr. | 404/11 |
| 4,352,484 | 10/1982 | Gertz et al. | 404/6 X |
| 4,367,975 | 1/1983 | Tyers | 404/6 |
| 4,407,484 | 10/1983 | Meinzer | 404/6 X |
| 4,490,068 | 12/1984 | Dickinson | 404/11 X |
| 4,630,395 | 12/1986 | Nasatka | 49/49 |

*Primary Examiner*—Stephen J. Novosad
*Assistant Examiner*—John F. Letchford
*Attorney, Agent, or Firm*—Anne D. Daniel; James H. Chafin; Judson R. Hightower

[57] ABSTRACT

An anti-terrorist vehicle crash barrier includes side support structures, crushable energy absorbing aluminum honeycomb modules, and an elongated impact-resistant beam extending between, and at its opposite ends through vertical guideways defined by, the side support structures. An actuating mechanism supports the beam at its opposite ends for movement between a lowered barrier-withdrawn position in which a traffic-supporting side of the beam is aligned with a traffic-bearing surface permitting vehicular traffic between the side support structures and over the beam, and a raised barrier-imposed position in which the beam is aligned with horizontal guideways defined in the side support structures above the traffic-bearing surface, providing an obstruction to vehicular traffic between the side support structures. The beam is movable rearwardly in the horizontal guideways with its opposite ends disposed transversely therethrough upon being impacted at its forward side by an incoming vehicle. The crushable modules are replaceably disposed in the horizontal guideways between aft ends thereof and the beam. The beam, replaceable modules, side support structures and actuating mechanism are separate and detached from one another such that the beam and replaceable modules are capable of coacting to disable and stop an incoming vehicle without causing structural damage to the side support structures and actuating mechanism.

27 Claims, 5 Drawing Sheets

ANTI-TERRORIST VEHICLE CRASH IMPACT ENERGY ABSORBING BARRIER

BACKGROUND OF THE INVENTION

1. Field of the Invention

The present invention relates generally to barriers for preventing vehicle passage and more particularly to a survivable anti-terrorist vehicle crash barrier incorporating replaceable impact energy absorbing components pursuant to Contract No. DE-AC04-76DP00789 awarded by the U.S. Department of Energy.

2. Description of the Prior Art

Terrorist threats especially to governmental facilities, such as embassies and military compounds, have become more acute in recent years. To prevent terrorists and other adversaries from using ground vehicles to penetrate the perimeters of such restricted and protected areas, the design and installation of an entrance barrier selectively actuatable to prevent passage of unauthorized vehicles and to permit passage of authorized vehicles is greatly needed, in addition to fixed barriers around the perimeter of the compound.

Many different vehicle barriers appear in the prior patent art for achievement of various goals, such as improving vehicular highway safety, impact energy absorption and traffic direction control. Representative examples are the prior art barriers disclosed in U.S. Pat. Nos. to Gravisse (3,448,963), Peterson et al (3,712,589), Brubaker (4,007,917), Meinzer (4,101,115), Hurst, Jr. (4,332,503), Gertz et al (4,352,484), Tyers (4,367,975), Meinzer (4,407,484) and Dickinson (4,490,068). However, none of these prior art barriers appear suitable for defending against vehicular crash-type penetrations through gates, entrances and other portals to governmental facilities.

Of all the above-cited patents, the Dickinson patent discloses a barrier that appears to have promise in effectively controlling normal vehicular traffic at entrances and exits of facilities such as parking lots and the like. Specifically, the barrier of the Dickinson patent is a below-pavement pivotally-mounted structure having an elongated curb-like configuration. Via operation of a pair of hydraulic cylinders, the curb-like barrier of Dickinson is selectively actuatable between a retracted position in which the barrier is disposed below pavement level with its outer surface member flush with the pavement to permit desired traffic flow over it and a raised position in which the barrier projects above pavement level giving the appearance of a curb-like structure to prevent traffic flow over it.

One major drawback of the barrier of Dickinson is that it presents an essentially rigid structure to the incoming vehicle. No substantial portion of the impacting vehicle's kinetic energy can be absorbed by the barrier without causing significant structural damage to it. Another important drawback is that the hydraulic cylinders of the barrier which pivot and position the curb-like structure are attached to it so that they are likely to be damaged along with it.

It appears that no amount of "beefing up" of the structural makeup of the Dickinson barrier would overcome the above-mentioned drawbacks. Although the Dickinson barrier may successfully stop an incoming vehicle, the barrier would undoubtedly be damaged so extensively as to not survive the impact. Complete replacement of the barrier would be necessary. Rather than stopping the vehicle, it is more likely that the abruptness of the vehicle's impact with the rigid barrier of Dickinson would propel a significant portion of the vehicle and its payload a distance beyond the barrier sufficient to accomplish at least part of the terrorist's objective.

In view of the above-noted drawbacks in the barrier of the Dickinson patent which also apply generally to most commercially available vehicle barriers, it is apparent that a pressing need remains unfulfilled for an anti-terrorist vehicle crash barrier that will be effective in stopping the entire vehicle, is survivable and can be placed back into operative condition within a short period of time.

SUMMARY OF THE INVENTION

The present invention provides an anti-terrorist vehicle crash impact energy absorbing barrier designed to satisfy the aforementioned needs. The vehicle crash barrier of the present invention incorporates a transverse impact-resistant beam backed up by replaceable modules composed of material adapted to absorb a significant portion of the impact energy of a terrorist-operated vehicle. The beam and modules will coact to disable and stop the terrorist-operated vehicle at the site of the vehicle crash barrier and as a result of the impact likely cause injury or death to any vehicle occupants without causing any structural damage to the non-replaceable components of the barrier.

The transverse beam of the vehicle crash barrier is selectively actuatable by a mechanism operable for moving the impact beam between a raised, barrier-imposed position and a lowered, barrier-withdrawn position. The beam, replaceable modules, side support structures which mount the modules and the actuating mechanism which supports the beam are separate and detached from one another, thereby reducing or eliminating the potential for damage to the side support structures and the actuating mechanism during an impact.

Accordingly, the present invention is directed to a vehicle crash impact energy absorbing barrier, comprising: (a) a pair of side support structures stationarily-mountable at opposite sides of an entrance to a facility, each support structure defining a generally horizontal guideway displaced above a vehicular traffic-bearing surface and having a forward end and closed aft end; (b) an elongated substantially impact-resistant beam having a pair of opposite ends, a forward impact-receiving side and an opposite rearward side, the impact beam being adapted to extend between the side support structures and at the opposite ends of the beam extend in transverse relation through the horizontal guideways of the side support structures for providing an obstruction to vehicular traffic between the side support structures through the facility entrance, the impact beam being slidably movable along the horizontal guideways toward the aft ends thereof upon being impacted at its forward side by an incoming vehicle; and (c) a pair of members being disposed in the horizontal guideways of the side support structures between a rearward side of the impact beam and the closed aft ends of the horizontal guideways, the members being adapted to absorb at least a significant portion of the kinetic energy produced by impact of the incoming vehicle against the forward side of the impact beam such that the beam and members are capable of coacting to disable and stop the incoming vehicle without causing structural damage to the side support structures.

More particularly, each side support structure of the vehicle crash barrier includes a pair of frictionreducing guide surface-defining members disposed along the horizontal guideway of the support structure respectively above and below the impact energy absorbing member therein. The beam at its opposite ends is adapted to fit between and slidably move along the pairs of guide surface-defining members and in contact with the energy absorbing members.

Also, the impact energy absorbing members of the vehicle crash barrier are preferably elongated modules composed of impact energy absorbing material, such as a crushable aluminum honeycomb structure. The modules are replaceable within the horizontal guideways and preferably are retained in the guideways by a pair of side plates carried by retaining rails and a front plate that is fastened to the side plates. Further, the impact beam of the vehicle crash barrier has an impact energy absorbing member mounted along its forward side. The energy absorbing member on the impact beam can also be composed of replaceable and crushable honeycomb structure. Still further, a concrete foundation is provided for mounting the side support structures at the opposite sides of the facility entrance.

The side support structures of the vehicle crash barrier also define generally vertical guideways. Each vertical guideway extends from a lower end disposed below the traffic-bearing surface to an open upper end disposed thereabove which intersects with the open forward end of the horizontal guideway.

The vehicle crash barrier further includes an actuating mechanism for replaceably supporting the impact beam extending transversely between the side support structures with opposite ends of the beam disposed transversely through the vertical guideway. The actuating mechanism is operable for moving the impact beam between a lowered barrier-withdrawn position in which the beam is disposed adjacent the lower end of the vertical guideway with its traffic-supporting side aligned with the traffic-bearing surface for permitting vehicular traffic through the facility entrance over the beam and a raised barrier-imposed position in which the beam is disposed adjacent the open upper ends of the vertical guideways in alignment with the open forward ends of the horizontal guideways for providing the obstruction to vehicular traffic through the facility entrance.

More particularly, the actuating mechanism includes a pair of hydraulic cylinders and support plates on the piston rod ends of the cylinders for supporting the impact beam at its opposite ends. The support plates have friction-reducing surface members thereon which underlie the beam and are aligned with the lower ones of the guide members in the side support structure horizontal guideways when the beam is in the raised position.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
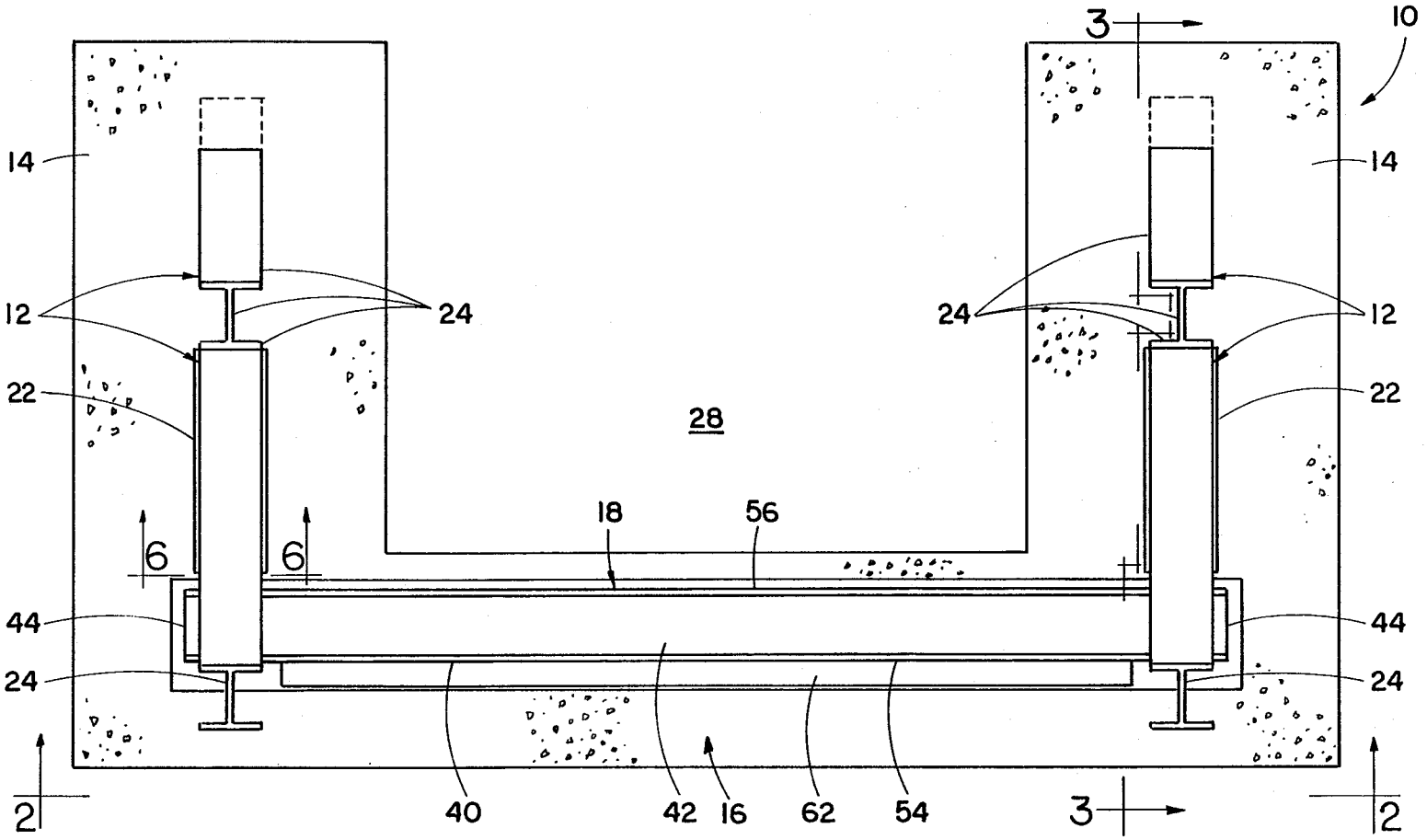
FIG. 1 is a top plan view of an anti-terrorist vehicle crash impact energy absorbing barrier constructed in accordance with the principles of the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Anti-Terrorist Vehicle Crash Barrier of Present Invention

Figure 2:
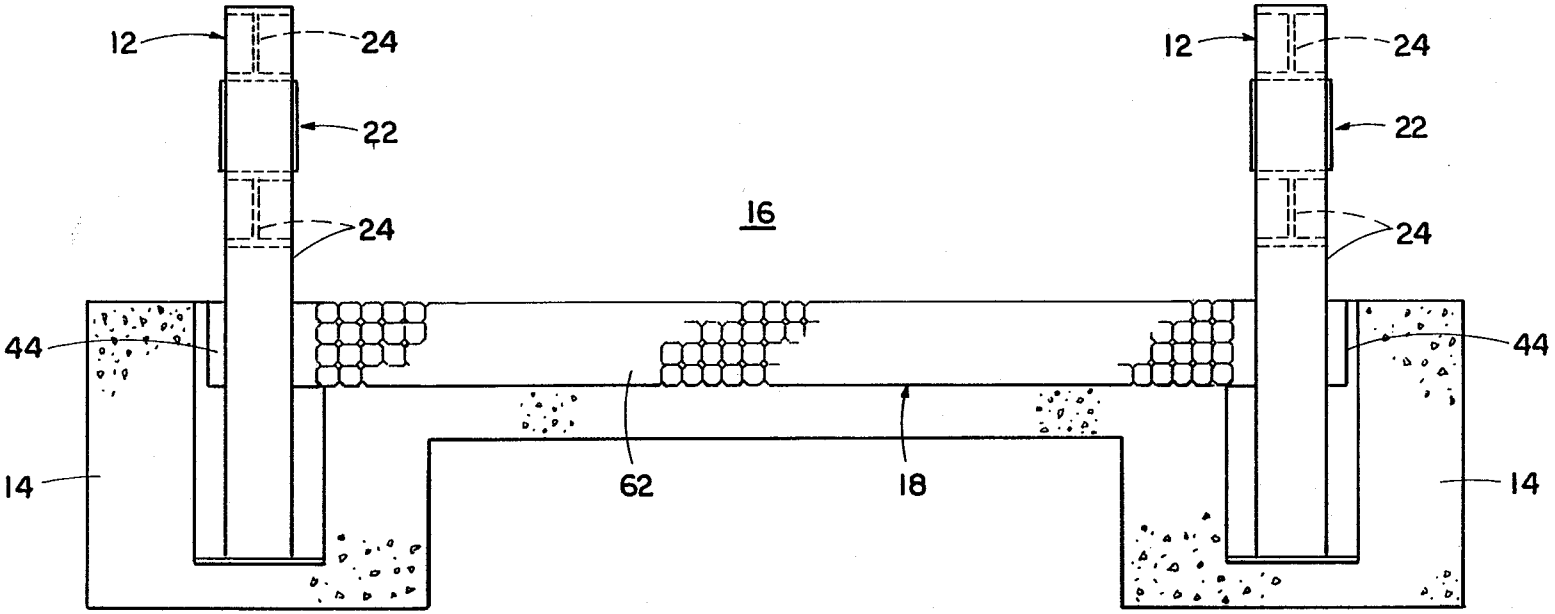
FIG. 2 is a front elevational view of the vehicle crash barrier as seen along line 2—2 of FIG. 1.
Figure 3:
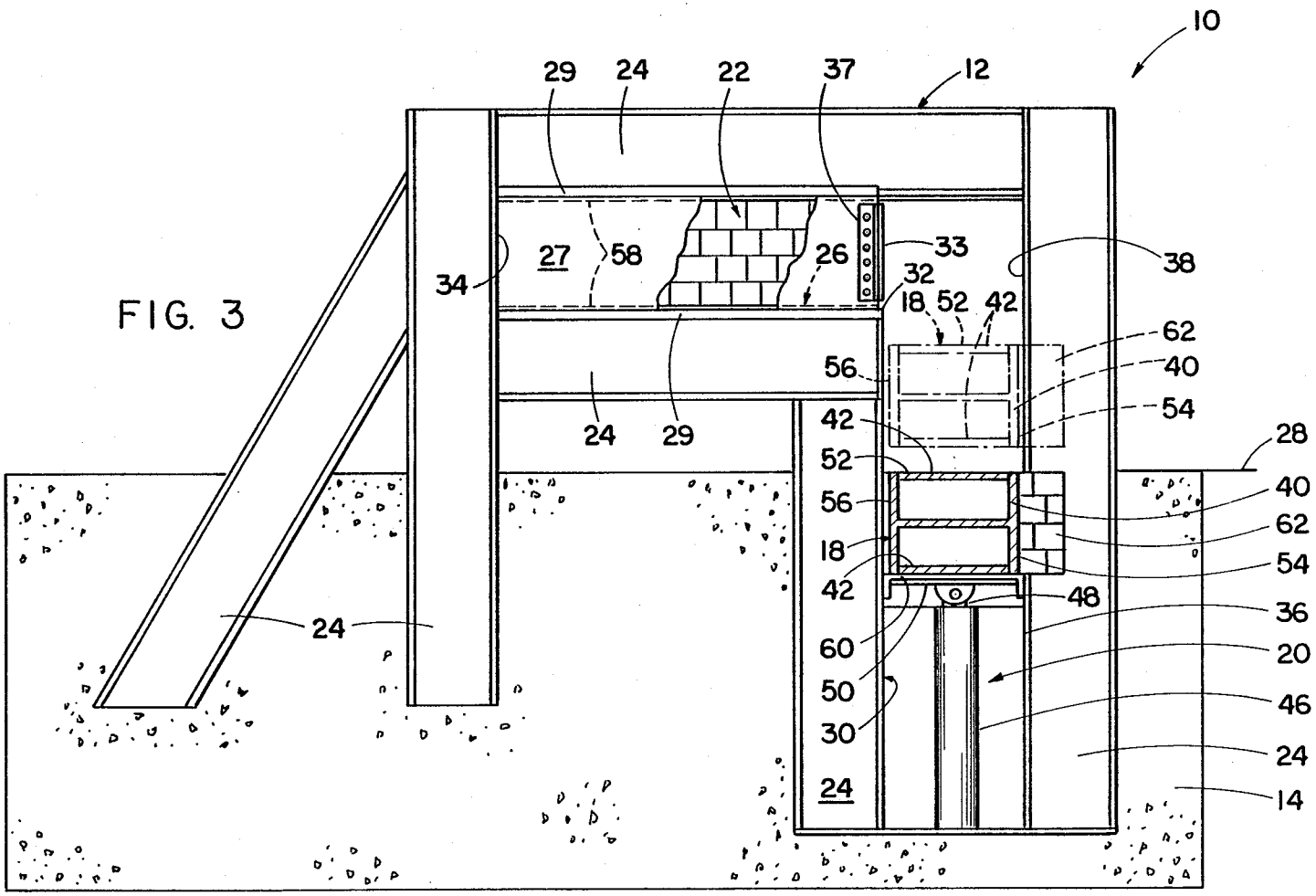
FIG. 3 is an enlarged side elevational view, partly in section, of the vehicle crash barrier as seen along line 3—3 of FIG. 1, illustrating in full line form a transverse impact beam of the barrier in a lowered or retracted barrier-withdrawn position and in dashed line form the beam in a partially raised or extended position.
Figure 5:
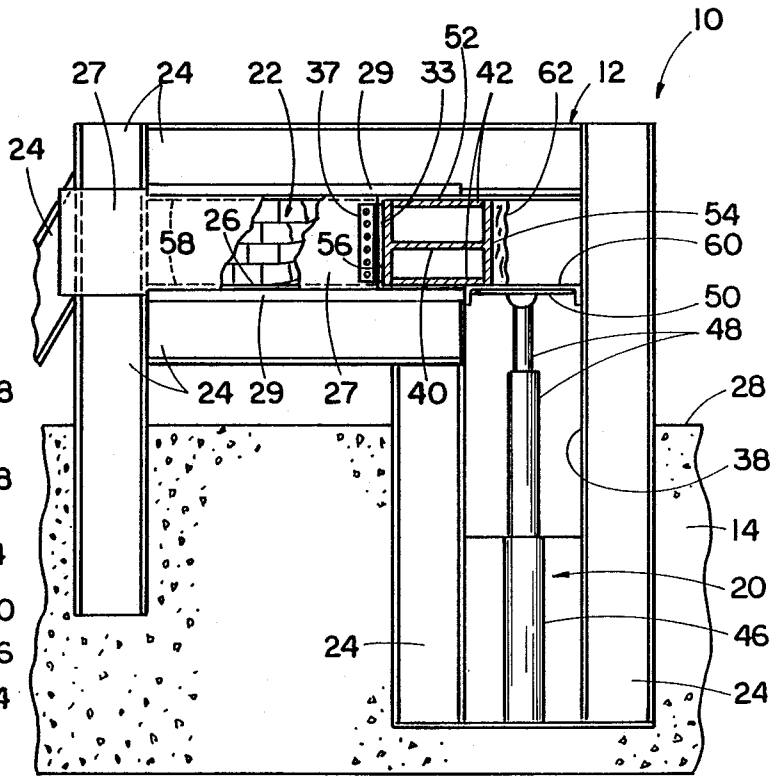
FIG. 5 is another side elevational view of the barrier similar to that of FIG. 4, but illustrating the condition of the barrier after its impact beam has been moved rearwardly in response to impact by the incoming vehicle.

Referring now to the drawings, and particularly to FIGS. 1 to 3, there is shown the preferred embodiment of the anti-terrorist vehicle crash impact energy absorbing barrier of the present invention, being generally designated by the numeral 10. The vehicle crash barrier 10 includes a pair of side support structures 12 mounted in a concrete foundation 14 at opposite sides of an entrance 16 to a facility, an elongated impact-resistant beam 18 extending between the side support structures 12, an actuating mechanism 20 that supports the impact beam 18, and replaceable and crushable impact energy absorbing modules 22 which backup the impact beam 18.

More particularly, each of the side support structures 12 of the barrier 10 is constructed of an arrangement of frame members 24, preferably being structural steel I-beams, rigidly attached to one another, such as by welding, and embedded in the concrete foundation 14. The arrangement of frame members 24 forming each side support structure 12 define a generally horizontal guideway 26 displaced above a traffic-bearing surface 28 located at the facility entrance 16 and a generally vertical guideway 30 which extends from below to above the traffic-bearing surface 28. The horizontal guideway 26 is open at its forward end 32 and closed at its aft end 34. The vertical guideway 30 extends from a lower end 36 disposed below the traffic-bearing surface 28 to an open upper end 38 disposed above the surface 28 and which intersects with the open forward end 32 of the horizontal guideway 26.

The elongated impact-resistant beam 18 of the barrier 10 is preferably constructed of a wide flange structural steel I-beam 40 having upper and lower steel reinforcing plates 42 rigidly attached thereto. The impact beam 18 is greater in length than the distance between the side support structures 12 such that when the beam 18 is placed between the side support structures 12, its opposite ends 44 can extend through the horizontal and vertical guideways 26,30 of side support structures 12.

The actuating mechanism 20 of the barrier 10 supports the impact beam 18 extending between the side support structures 12 with the opposite ends 44 of the beam 18 extending transversely through the vertical guideways 30 of the support structures 12. Specifically, the actuating mechanism 20 includes a pair of actuators 46 with vertically extendible and retractable members 48, preferably in the form of hydraulic cylinders with reciprocal piston rods, disposed within the vertical guideways 30 below the opposite ends 44 of the impact beam 18. The piston rods 48 of the hydraulic cylinders 46 mount support plates 50 which, in turn, underlie, and support the impact beam 18 at its opposite ends 44. The impact beam 18 is supported by the support plates 50 without being attached thereto. The beam 18 merely rests upon the support plates 50.

Figure 4:
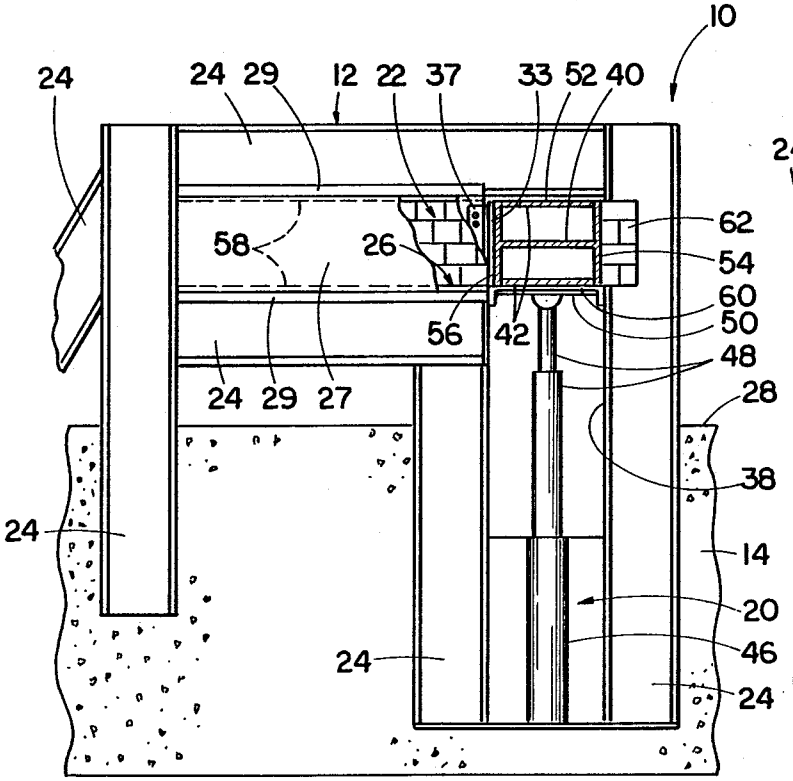
FIG. 4 is a side elevational view of the vehicle crash barrier similar to that of FIG. 3, but on a somewhat smaller scale and illustrating the condition of the barrier with its impact beam located in a fully raised or extended barrier-imposed position before impact by an incoming vehicle.

The hydraulic cylinders 46 can be actuated by the operation of suitable hydraulic controls (not shown) in a conventional manner to move the impact beam 18 between a lowered barrier-withdrawn position (FIG. 3) and a raised barrier-imposed position (FIG. 4). In the lowered barrier-withdrawn position, the beam 18 is disposed adjacent the lower ends 36 of the vertical guideways 30 above the hydraulic cylinders 46 with an upper traffic-supporting side 52 of the impact beam 18 aligned with the traffic-bearing surface 28 of the facility entrance 16. In such lowered position of the beam 18 with its upper side 52 aligned flush with the entrance surface 28, vehicular traffic is permitted between the side support structures 12 through the entrance 16 and over the impact beam 18. However, in the raised barrier-imposed position, the beam 18 is disposed adjacent the open upper ends 38 of the vertical guideways 30 in alignment with open forward ends 32 of horizontal guideways 26 for providing an obstruction to vehicular traffic between the side support structures 12 and through the entrance 16. In such raised position, when the beam 18 is impacted at its forward side 54 by an incoming vehicle the beam can be moved along the horizontal guideways 26 toward the closed aft ends 34 thereof with the beam ends 44 disposed transversely through the horizontal guideways 26.

Figure 6:
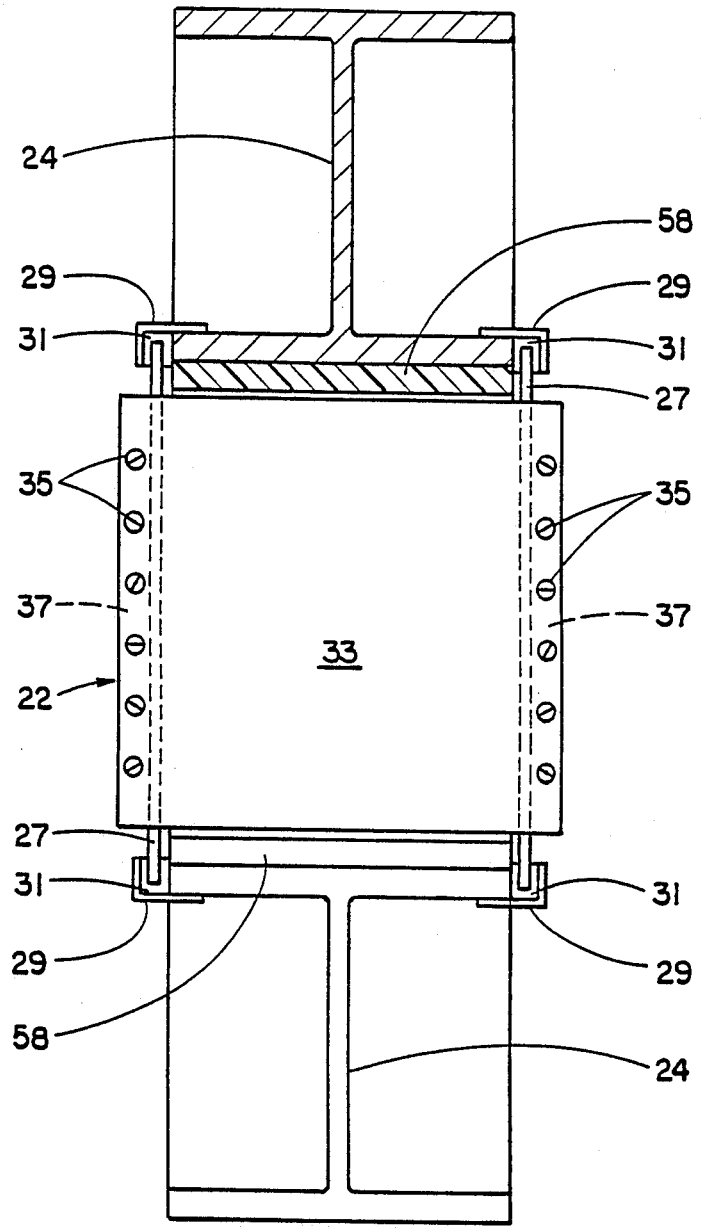
FIG. 6 is an enlarged sectional view taken along line 6—6 of FIG. 1 showing in more detail the side plates and front plate and associated retaining rails that retain the modules within their respective guideways.

The elongated modules 22 of the barrier 18 are replaceably disposed in the horizontal guideways 26 of the side support structures 12 between a rearward side 56 of the beam 18 and the closed aft ends 34 of the horizontal guideways 26. The modules 22 are composed of any suitable material, such as medium density crushable aluminum honeycomb material being rectangular in shape, adapted to absorb at least a significant portion of the kinetic energy produced by impact of an incoming vehicle against the forward side 54 of the impact beam 18. The crushable modules 22 are thus located behind the opposite ends 44 of the beam 18. As best seen in FIG. 6, the honeycomb modules 22 are retained within the horizontal guideways 26 by a pair of stainless steel side plates 27 that are captured within respective sets of upper and lower retainer rails 29, being in the form of angle irons, that are attached to the flange portions of the respective upper and lower I-beam frame members 24 which define the horizontal guideways 26. Associated with each retainer rail 29 is a U-shaped nylon guide member 31 that carries the upper and lower edges of the side plates 27. Also, extending across the front face of each module 22 is a stainless steel front plate 33 which is suitably attached by fasteners 35 at its left and right edges to the respective front edges of the spaced apart side plates 27 by a pair of vertical attaching members 37 which are also in the form of angle irons. The purpose of the side and front plates 27,33 is to restrain the energy absorbing modules 22 within the guideways 26 and keep them from buckling to one side or the other upon impact of the barrier beam 18.

The modules 22 are designed to be slightly weaker than the ultimate strength of the beam 18. They, therefore, crush when the beam 18 is impacted at its forward side 54 and dissipate relatively large amounts of energy (approximately 500,000 ft-lbs). The modules 22 can be replaced very quickly following an impact to restore the operational status of the barrier 10.

However, the beam 18 is the part of the barrier 10 which is actually impacted by an incoming vehicle. The beam 18 transmits the force of impact to the honeycomb modules 22 behind it, which dissipate the energy. When the honeycomb modules are totally crushed, the beam 18 continues to exert a resistive force on the vehicle which causes massive damage to the vehicle, with a high probability of injury or death to the vehicle occupants.

Furthermore, for facilitating sliding movement of the beam 18 rearwardly along the horizontal guideways 26 and deterring hangup of one or the other of its opposite ends 44 therealong, a pair of friction-reducing guide surface-defining members in the form of one inch thick nylon guide plates 58 are disposed in vertically spaced relation from one another and along each of the horizontal guideways 26. The guide plates 58 are located between respective top and bottom surfaces of each of the replaceable modules 22 and the portions of the frame member arrangements of the side support structures 12 which define the horizontal guideways 26. Also, for the same purpose, friction-reducing guide surface-defining members in the form of nylon guide plates 60 are mounted on the support plates 50 and underlie the opposite ends 44 of the impact beam 18. The guide plates 60 on the support plates 50 are aligned flush with the lower ones of the guide plates 58 in the horizontal guideways 26 below the modules 22 when the beam 18 is in its raised position so as to facilitate smooth movement of the beam 18 from the support plates 50 into the horizontal guideways 26.

Finally, an impact energy absorbing member 62 is replaceably mounted to the forward side 54 of the impact beam 18. The member 62 is preferably in the form of a plurality of low density aluminum honeycomb modules attached to the beam 18. These modules 62 are basically a safety feature to reduce the chances of injury to personnel in vehicles who may inadvertently run into the beam 18 at low speeds. These modules 62 can also be quickly replaced and are capable of absorbing approximately 25,000 ft-lbs of kinetic energy.

It should be recognized that the impact beam 18, replaceable impact energy absorbing modules 22, side support structures 12 and actuating mechanism 20 are separate and detached from one another although they cooperate with one another as described above in effectively fulfilling the overall objective of the vehicle crash barrier 10 to stop passage of terrorist-operated vehicles through the entrance 16. The impact beam 18 and replaceable modules 22 are capable of coacting to disable and stop the incoming vehicle without causing structural damage to the side support structures 12 and actuating mechanism 20. However, by having the impact beam 18 separated from the honeycomb modules 22 behind it, the beam can be moved much faster by the actuating mechanism 20. Separation of the parts also enables the beam 18 to be easily replaced if required.

The barrier 10 just described is thus capable of being placed in an inoperative condition, with its beam 18 lowered and withdrawn below the surface 52 of the entrance 16, allowing authorized vehicles to pass uninterrupted through the entrance. However, normally, the barrier 10 would be placed in an operative condition, with its beam 18 raised and extended above the surface 52 of the entrance 16, preventing passage of unauthorized vehicles through the entrance. By leaving the barrier 10 in the operative condition, this eliminates the human reaction time and judgment that would be necessary if the barrier were to be raised only upon approach of a suspected threat vehicle. Thus, the beam 18 will always be in the raised position until vehicles are approved for entry.

One of the major factors which adds to the overall effectiveness of the barrier 10 results from the large resistive force which the main impact beam 18 exerts on an impacting vehicle. In many instances, the large resistive force of the barrier's beam 18 will cause small vehicles, i.e., pickup trucks, to dissipate most of their kinetic energy through self-deformation. In the event of an impact with a larger more rigid vehicle, the energy dissipation will be divided between vehicle self-deformation and crushing of the aluminum honeycomb modules 22. If an impacting vehicle possessed enough kinetic energy to crush the honeycomb modules 22 and cause the main impact beam 18 to bottom out, the beam would still apply a resistive force to the vehicle sufficient to cause even more self-deformation of the vehicle.

An additional benefit realized by using crushable honeycomb modules in the barrier 10 is that the vehicle is stopped over a slightly longer distance, for example 3–4 feet, than if it had impacted a rigid barrier. By doing this, the peak and average decelerations of the vehicle are reduced, thereby reducing the distance which parts of the load are propelled beyond the point of impact. A truly rigid barrier would cause the vehicle to break up sooner, and the load could conceivably travel well beyond the barrier.

The beam 18 when in its raised position is preferably located at a height which will prevent most vehicles from flying over the barrier 10 or from causing the vehicle to flip over the barrier on impact. The proper beam height along with the large size of the flange on the beam combine to keep most of the vehicle and its parts on the impact side of the barrier.

It is believed appropriate to use honeycomb modules 22 that are approximately at least twenty-five percent weaker than the force needed to cause the beam 18 to reach its ultimate yield strength in bending. By using such weaker honeycomb behind the beam, it should be possible to achieve the design goal of stopping an intruding vehicle possessing less than 1.2 million ft-lb of kinetic energy without causing any structural damage to the barrier. If the beam 18 is damaged, the ease of installation thereof will allow the barrier to be brought back into operation within hours. It should be realized also, that in an emergency situation if honeycomb were not available, the beam 18 can be used effectively alone to stop large vehicles; however, permanent structural damage is likely to occur to the main beam.

To minimize or eliminate beam damage, i.e. permanent bending, it is felt that a honeycomb material having crush strengths in the 400–425 psi range should work well in conjunction with a reinforced 14 inch by 120 pound per foot wide flange beam. If a barrier with increased or reduced stopping capability is desired, an appropriate size beam could be used. If a different size main beam is used, then the resistive force of the honeycomb behind the beam should be approximately seventy-five percent of the force required to yield the beam in bending.

It is thought that the vehicle crash barrier of the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. A vehicle crash impact energy absorbing barrier, comprising:

(a) a pair of side support structures stationarily-mountable at opposite sides of an entrance to a facility, each support structure defining a generally horizontal guideway displaced above a vehicular traffic-bearing surface and having a forward end and closed aft end;

(b) an elongated substantially impact-resistant beam having a pair of opposite ends, a forward impact-receiving side and an opposite rearward side, said impact beam being adapted to extend between said side support structures and at said opposite ends of said beam extend in transverse relation through said horizontal guideways of said side support structures for providing an obstruction to vehicular traffic between said side support structures through the facility entrance, said impact beam being slidably movable along said horizontal guideways toward said aft ends thereof upon being impacted at its forward side by an incoming vehicle; and (c) a pair of members being disposed in said horizontal guideways of said side support structures between a rearward side of said impact beam and said closed aft ends of said horizontal guideways, said members being adapted to absorb at least a significant portion of the kinetic energy produced by impact of the incoming vehicle against said forward side of said impact beam such that said beam and members are capable of coacting to disable and stop the incoming vehicle without causing structural damage to said support structures.

2. The vehicle crash barrier as recited in claim 1, wherein each side support structure includes a pair of friction-reducing guide surface-defining members disposed along said horizontal guideway respectively above and below said impact energy absorbing member, said beam at its opposite ends being adapted to fit between and slidably move along said pairs of guide surface-defining members.

3. The vehicle crash barrier as recited in claim 2, wherein each of said guide surface-defining members is a nylon guide plate.

4. The vehicle crash barrier as recited in claim 1, wherein said impact energy absorbing members are crushable modules composed of impact energy absorbing material and being replaceable within said horizontal guideways.

5. The vehicle crash barrier as recited in claim 1, wherein said impact energy absorbing members are crushable medium density aluminum honeycomb structures.

6. The vehicle crash barrier as recited in claim 1, wherein said impact energy absorbing members are crushable aluminum honeycomb modules being replaceable within said horizontal guideways.

7. The vehicle crash barrier as recited in claim 1, wherein said impact beam has an impact energy absorbing member mounted along its forward side.

8. The vehicle crash barrier as recited in claim 1, wherein said impact beam has a crushable low density aluminum honeycomb structure mounted along its forward side.

9. The vehicle crash barrier as recited in claim 1, wherein said impact beam has a crushable aluminum honeycomb structure replaceably mounted along its forward side.

10. The vehicle crash barrier as recited in claim 1, wherein said impact beam, side support structures and impact energy absorbing members are separate and detached from one another.

11. The vehicle crash barrier as recited in claim 1, further comprising:

(d) a concrete foundation for stationarily-mounting said side support structures at the opposite sides of the facility entrance.

12. A vehicle crash impact energy absorbing barrier, comprising:

(a) a pair of side support structures stationarily-mountable at opposite sides of an entrance to a facility, each support structure defining a generally horizontal guideway displaced above a traffic-bearing surface and being open at a forward end and closed at an aft end, each support structure also defining a generally vertical guideway which extends from a lower end disposed below the traffic-bearing surface to an open upper end disposed thereabove which intersects with said open forward end of said horizontal guideway;

(b) an elongated substantially impact-resistant beam being greater in length than the distance between said side support structures, said impact beam having a pair of opposite ends, an upper traffic-supporting side, a forward impact-receiving side and an opposite rearward side;

(c) an actuating mechanism for replaceably supporting said impact beam transversely between said side support structures with opposite ends of said beam disposed transversely through said vertical guideways, said actuating mechanism being operable for moving said impact beam between a lowered barrier-withdrawn position in which said beam is disposed adjacent said lower ends of said vertical guideways with its traffic-supporting side aligned with the traffic-bearing surface for permitting vehicular traffic between said side support structures through the facility entrance over said beam and a raised barrier-imposed position in which said beam is disposed adjacent said open upper ends of said vertical guideways in alignment with said open forward ends of said horizontal guideways for providing an obstruction to vehicular traffic between said side support structures through the facility entrance, said beam being slidably movable along said horizontal guideways toward said aft ends thereof with opposite ends of said beam disposed transversely through said horizontal guideways upon said beam being impacted at its forward side by an incoming vehicle; and (d) a pair of modules being replaceably disposed in said horizontal guideways of said side support structures between said rearward side of said impact beam and said closed aft ends of said horizontal guideways, said modules being composed of material adapted to absorb at least a significant portion of the kinetic energy produced by impact of the incoming vehicle against said forward side of said impact beam;

(e) each of said impact beam, impact energy absorbing modules, side support structures and actuating mechanism being separate and detached from one another such that said impact beam and impact energy absorbing modules are capable of coacting to disable and stop the incoming vehicle without causing structural damage to said side support structures and actuating mechanism thereof.

13. The vehicle crash barrier as recited in claim 12, wherein each side support structure includes a pair of friction-reducing guide surface-defining members disposed along said horizontal guideway respectively above and below said impact energy absorbing member, said beam at its opposite ends being adapted to fit between and slidably move along said pairs of guide surface-defining members.

14. The vehicle crash barrier as recited in claim 13, wherein each of said guide surface-defining members is a nylon guide plate.

15. The vehicle crash barrier as recited in claim 12, wherein said impact energy absorbing modules are composed of crushable material and are replaceable within said horizontal guideways.

16. The vehicle crash barrier as recited in claim 15, wherein said crushable material is medium density aluminum honeycomb.

17. The vehicle crash barrier as recited in claim 12, wherein said impact beam has at least one impact energy absorbing module mounted along its forward side.

18. The vehicle crash barrier as recited in claim 17, wherein said impact energy absorbing module is composed of crushable material and is replaceably mounted to said forward side of said impact beam.

19. The vehicle crash barrier as recited in claim 17, wherein said crushable material is low density aluminum honeycomb.

20. The vehicle crash barrier as recited in claim 12, further comprising:

(f) a concrete foundation for stationarily-mounting said side support structures at the opposite sides of the facility entrance.

21. The vehicle crash barrier as recited in claim 12, wherein said actuating mechanism includes:

a pair of hydraulic cylinders disposed below said opposite ends of said impact beam and having extendible and retractable piston rod ends; and support plates mounted on said respective piston rod ends of the cylinders for supporting said impact beam at its opposite ends.

22. The vehicle crash barrier as recited in claim 21, wherein said support plates have friction-reducing guide surface-defining members thereon which underlie said impact beam at its opposite ends and are aligned with the lower ones of said guide surfacedefining members in said side support structure horizontal guideways when said beam is in its raised position.

23. A vehicle crash impact energy absorbing barrier, comprising:

(a) a pair of side support structures stationarily-mountable at opposite sides of an entrance to a facility, each support structure defining a generally horizontal guideway displaced above a traffic-bearing surface and being open at a forward end and closed at an aft end, each support structure also defining a generally vertical guideway which extends from a lower end disposed below the traffic-bearing surface to an open upper end disposed thereabove which intersects with said open forward end of said horizontal guideway;

(b) a pair of friction-reducing guide surface-defining members disposed in vertically spaced relation from one another and along said horizontal guideway of each of said side support structures;

(c) an elongated substantially impact-resistant beam being greater in length than the distance between said side support structures, said impact beam having a pair of opposite ends, an upper traffic-supporting side, a forward impact-receiving side and an opposite rearward side;

(d) at least one impact energy absorbing member replaceably mounted to said forward side of said impact beam and being composed of crushable aluminum honeycomb material;

(e) an actuating mechanism for replaceably supporting said impact beam at its opposite ends such that said beam extends transversely between said side support structures with opposite ends of said beam disposed transversely through said vertical guideway, said actuating mechanism being operable for moving said impact beam between a lowered barrier-withdrawn position in which said beam is disposed adjacent said lower end of said vertical guideway with its traffic-supporting side aligned with the traffic-bearing surface for permitting vehicular traffic between said side support structures through the facility entrance over said beam and a raised barrier-imposed position in which said beam is disposed adjacent said open upper ends of said vertical guideways in alignment with said open forward ends of said horizontal guideways for providing an obstruction to vehicular traffic between said side support structures through the facility entrance, said beam at its opposite ends being adapted to fit between and slidably movable along said pairs of guide surface-defining members disposed in horizontal guideways and toward said aft ends thereof upon said beam being impacted at its forward side by an incoming vehicle;

(f) said actuating mechanism including a pair of actuators disposed below said opposite ends of said impact beam and having extendible and retractable members, and support plates mounted on said actuator members for supporting said impact beam at its opposite ends, said support plates having friction-reducing guide surface-defining members thereon which underlie said impact beam at its opposite ends and are aligned with the lower ones of said guide surface-defining members in said side support structure horizontal guideways when said beam is in its raised position; and (g) a pair of elongated modules being replaceably disposed in said horizontal guideways of said side support structures between said rearward side of said impact beam and said closed aft ends of said horizontal guideways, said modules being composed of crushable aluminum honeycomb material adapted to absorb at least a significant portion of the kinetic energy produced by impact of the incoming vehicle against said forward side of said impact beam;

(h) each of said impact beam, replaceable modules, side support structures and actuating mechanism being separate and detached from one another such that said impact beam and impact energy absorbing modules are capable of coacting to disable and stop the incoming vehicle without causing structural damage to said side support structures and actuating mechanism thereof;

24. The vehicle crash barrier as recited in claim 23, wherein each of said guide surface-defining members is a nylon guide plate.

25. The vehicle crash barrier as recited in claim 23, wherein said crushable material of said replaceable modules is medium density aluminum honeycomb material.

26. The vehicle crash barrier as recited in claim 23, wherein said crushable material of said module on said impact beam is low density aluminum honeycomb material.

27. The vehicle crash barrier as recited in claim 23, further comprising:

(i) a concrete foundation for stationarily-mounting said side support structures at the opposite sides of the facility entrance.

* * * * *